US012655689B2

(12) United States Patent
Stewart

(10) Patent No.: US 12,655,689 B2
(45) Date of Patent: Jun. 16, 2026

(54) WELL LOCATION OPTIMIZER FOR HIGH INCLINATION COMPLEX WELL TRAJECTORIES

(71) Applicant: Saudi Arabian Oil Company, Dhahran (SA)

(72) Inventor: Simon A. Stewart, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 1146 days.

(21) Appl. No.: 17/643,361

(22) Filed: Dec. 8, 2021

(65) Prior Publication Data

US 2023/0175355 A1 Jun. 8, 2023

(51) Int. Cl.
*E21B 7/04* (2006.01)

(52) U.S. Cl.
CPC ..... *E21B 7/04* (2013.01); *E21B 2200/20* (2020.05)

(58) Field of Classification Search
CPC ..... E21B 7/04; E21B 2200/20
USPC ..... 703/10
See application file for complete search history.

(56) References Cited

U.S. PATENT DOCUMENTS 8,694,257 B2 * 4/2014 Zamanian ..... E21B 47/024 702/6
8,812,334 B2 * 8/2014 Givens ..... G06Q 10/06312 705/7.22
8,849,640 B2 * 9/2014 Holl ..... E21B 47/022 703/10
8,892,407 B2 * 11/2014 Budiman ..... E21B 47/022 703/2
9,593,558 B2 * 3/2017 Sequeira, Jr. ..... E21B 41/00
10,422,924 B2 9/2019 Zhang et al.
11,015,433 B2 5/2021 Li et al.
11,466,555 B2 * 10/2022 Samuel ..... E21B 44/005
11,815,650 B2 * 11/2023 Tawil ..... G06F 17/18
12,086,515 B2 * 9/2024 Guillot ..... G06F 30/27
(Continued)

FOREIGN PATENT DOCUMENTS

CN 105089658 11/2015
WO WO 2009055152 4/2009
(Continued)

OTHER PUBLICATIONS

Serhii Petrovych Tyvonchuk (Predicting of the Geometrical Behavior of Formations in Subsurface Based on the Analysis of LWD/MWD Data While Drilling Horizontal Wells, SPE, 2021, pp. 1-18). (Year: 2021).*

(Continued)

*Primary Examiner* — Iftekhar A Khan
(74) *Attorney, Agent, or Firm* — Fish & Richardson P.C.

(57) ABSTRACT

A computer-implemented method for well location optimization for high inclination complex well trajectories includes calculating a thickness of a target geological layer with respect to a planned intersection angle between wellbores and the target geological layer, wherein the target geological layer comprises a known complex geology. A sensitivity of the wellbores is calculated based on reservoir parameters derived from the calculated thickness of the target geological layer at the planned intersection angle. A least sensitive wellbore is selected from the wellbores, wherein the least sensitive wellbore of the wellbores has a lowest uncertainty in geological layer orientation and wellbore orientation.

20 Claims, 8 Drawing Sheets

100

(56) References Cited

U.S. PATENT DOCUMENTS

2003/0046005 A1* 3/2003 Haarstad ..... E21B 47/022 702/9
2007/0143020 A1* 6/2007 Bradford ..... G01V 1/40 702/6
2011/0106514 A1* 5/2011 Omeragic ..... G01V 11/00 703/10
2012/0048618 A1* 3/2012 Zamanian ..... E21B 47/024 702/6
2013/0118809 A1* 5/2013 Veeningen ..... E21B 47/02 175/45
2014/0278110 A1* 9/2014 Chugunov ..... G01V 11/00 702/6
2015/0129306 A1* 5/2015 Coffman ..... E21B 44/00 175/48
2015/0134255 A1* 5/2015 Zhang ..... G01V 1/40 702/14
2015/0355374 A1* 12/2015 Morton ..... G01V 1/50 703/10
2016/0123118 A1* 5/2016 Downton ..... E21B 7/00 703/7
2017/0241253 A1* 8/2017 Chapman ..... E21B 47/12
2018/0334896 A1* 11/2018 Samuel ..... E21B 49/003
2020/0242286 A1* 7/2020 Marchidan ..... G06F 30/20
2020/0386094 A1* 12/2020 Simeonov ..... E21B 47/022
2022/0244415 A1* 8/2022 Stewart ..... G01V 1/307
2022/0291418 A1* 9/2022 Noufal ..... G01V 20/00
2023/0075327 A1* 3/2023 Mishra ..... E21B 49/00
2023/0186000 A1* 6/2023 Ozbek ..... E21B 41/00 175/61
2023/0195952 A1* 6/2023 Guillot ..... E21B 49/00 175/24

FOREIGN PATENT DOCUMENTS

WO WO 2009064728 A1 5/2009
WO WO 2019051435 A1 3/2019

OTHER PUBLICATIONS

Moradi et al. (Uncertainty assessment of wellbore stability analysis in horizontal sections, Springer Nature Switzerland AG 2020, pp. 1-6) (Year: 2020).*
Riegert et al. (Well Path Design Optimization Under Geological Uncertainty: Application to a Complex North Sea Field, SPE, 2010, pp. 1-11) (Year: 2010).*
Nasrabadi, et al., "Well placement optimization: A survey with special focus on application for gas/gas-condensate reservoirs," Journal of Natural Gas Science and Engineering, Mar. 2012, 5:6-16, 11 pages.
Schulze-Riegert, et al., "Well Path Design Optimization Under Geological Uncertainty: Application to a Complex North Sea Field," SPE Russian Oil & Gas Technical Conference and Exhibition, Oct. 2010, 11 pages.
SAIP Examination Report in Saudi Arabian Appln. No. 122440759, mailed on Mar. 11, 2025, 13 pages (with English translation).

* cited by examiner

100

200

300

400

500

600

700

800

WELL LOCATION OPTIMIZER FOR HIGH INCLINATION COMPLEX WELL TRAJECTORIES

TECHNICAL FIELD

This disclosure relates generally to drilling wells into the deep subsurface for commercial projects such as oil and gas or geothermal, and more particularly to the planning process for complex, high angle, high-stepout 3D wells.

BACKGROUND

Generally, well trajectories are designed to reach a desired target, typically located away from the surface location of the well, at a specified depth and angle. Accordingly, the azimuth and inclination of the well trajectory impacts the directional drilling performance, including a rate of penetration (ROP) and wellbore stability. Moreover, a number of constraints impact the ultimate production of the well. Some constraints are considered during well planning.

SUMMARY

An embodiment described herein provides a computer-implemented method for well location optimization for high inclination complex well trajectories. The method includes calculating a thickness of a target geological layer with respect to a planned intersection angle between wellbores and the target geological layer, wherein the target geological layer comprises a known complex geology. The method also includes calculating a sensitivity of the wellbores based on reservoir parameters derived from the calculated thickness of the target geological layer at the planned intersection angle. The method includes selecting a least sensitive wellbore from the wellbores, wherein the least sensitive wellbore of the wellbores has a lowest uncertainty in geological layer orientation and wellbore orientation.

An embodiment described herein provides a system. The system includes one or more memory modules and one or more hardware processors communicably coupled to the one or more memory modules. The one or more hardware processors are configured to execute instructions stored on the one or more memory models to perform operations. The operations include calculating a thickness of a target geological layer with respect to a planned intersection angle between wellbores and the target geological layer, wherein the target geological layer comprises a known complex geology. The operations also include calculating a sensitivity of the wellbores based on reservoir parameters derived from the calculated thickness of the target geological layer at the planned intersection angle. The operations include selecting a least sensitive wellbore from the wellbores, wherein the least sensitive wellbore of the wellbores has a lowest uncertainty in geological layer orientation and wellbore orientation.

An embodiment described herein provides an apparatus. The apparatus includes a non-transitory, computer readable, storage medium that stores instructions that, when executed by at least one processor, cause the at least one processor to perform operations. The operations include calculating a thickness of a target geological layer with respect to a planned intersection angle between wellbores and the target geological layer, wherein the target geological layer comprises a known complex geology. The operations also include calculating a sensitivity of the wellbores based on reservoir parameters derived from the calculated thickness of the target geological layer at the planned intersection angle. The operations include selecting a least sensitive wellbore from the wellbores, wherein the least sensitive wellbore of the wellbores has a lowest uncertainty in geological layer orientation and wellbore orientation.

DETAILED DESCRIPTION

Figure 1:
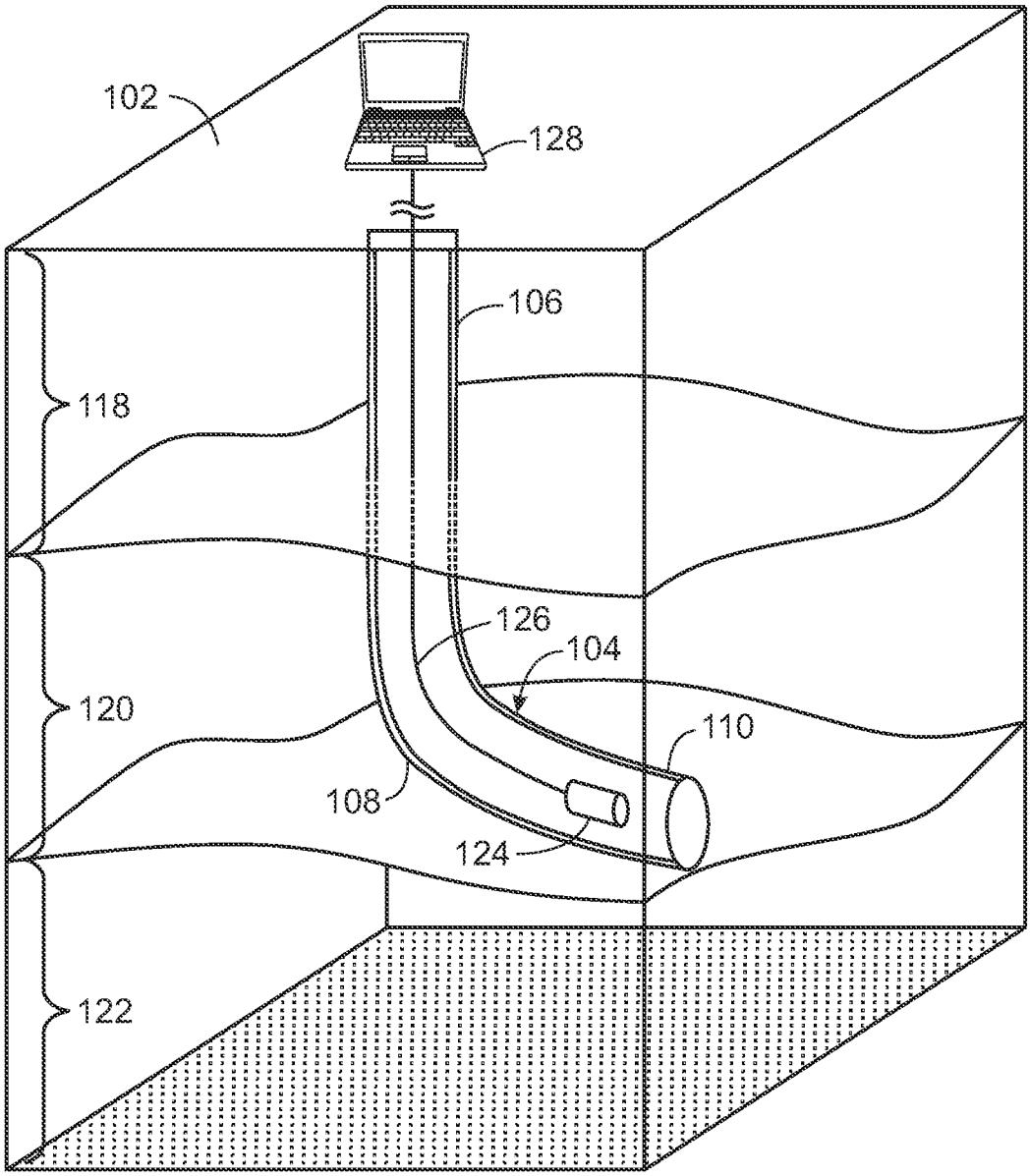
FIG. 1 is a schematic diagram of an example implementation of a wellbore system.

Embodiments described herein enable well location optimization for high inclination complex well trajectories. Depending on the particular geological layer formation, well plans often include high-angle, complex wells. Generally, a well plan describes one or more proposed wellbores, including the shape, orientation, depth, completion, and evaluation of each well bore. Directional or horizontal wellbores typically require detailed planning about where to land the well and begin directional drilling, how long the directional or horizontal section should be, and how to evaluate and complete the well. Well plans are designed to optimize production from reservoirs or align with the specific requirements of planned projected, including geothermal or CO2 sequestration projects.

In examples, complex well plans are due to, for example, a surface location that is constrained. A constrained surface includes, for example an offshore platform from which wells are drilled radiating out to distant targets. In another example, a complex well plan is due to drilling close to parallel next to a geological layer, thereby enhancing production or injection with respect to the geological layer. Generally, geological layers are relatively flat-lying and such a well is drilled at a high angle with respect to the geological layers. Additionally, well planning includes a number of constraints on the well plan in 3D space, such as wellbore curvature and well orientation in geologically weak horizons. Designing a well plan within these constraints according to traditional techniques is specialist work.

In particular, traditional wells are planned via a laborious process of trial and error involving different technical specialists from Drilling and Geoscience disciplines exchanging several iterations of a well plan to ensure the proposed well will achieve all the objectives demanded by the project. As a result, traditional well planning rarely takes into account uncertainties such as the geological layers having a different orientation at the target location than expected. Coping with these different scenarios (e.g., geological targets with multiple, alternative orientations and locations)

would further lengthen the planning process. Moreover, traditional techniques fail to identify which, if any, aspect of geometrical uncertainty (e.g., well inclination, well azimuth, geological dip or geological dip direction) is most impactful at a given target location. Similarly, traditional techniques fail to enable comparison of alternative trajectories in terms of their exposure to this geometrical uncertainty and therefore it is difficult to select the trajectory that most effectively minimizes geometrical uncertainty. Embodiments described herein optimize well locations for high inclination, complex well trajectories. In embodiments, the present techniques determine which geometrical uncertainty has the biggest impact on an intersection angle, and in turn this analysis can be quickly repeated for multiple target trajectories, enabling them to be ranked on this basis, and the most robust, lowest risk trajectory chosen (other things being equal).

FIG. 1 is a schematic diagram of an example implementation of a wellbore system 100 according to the present disclosure. In some aspects, the wellbore system 100 (all or part of it) may provide a wellbore system and computational framework (for example, embodied in control system 128) for optimizing well locations for high inclination complex well trajectories. In some aspects, the wellbore system 100 (and the computational framework) includes a planned high inclination complex wellbore trajectory 104.

In some aspects, the computational framework (for example, executed on a control system 128) of wellbore system 100 provides for a calculation of thickness of a geological layer (e.g., geological layers 118, 120, and 122) as will be seen in the planned well, according to a planned intersection angle between the wellbore and the target geological layer. The computational framework of wellbore system 100 accounts for an intersection angle combined with the minimum thickness of the target geological layer to determine other reservoir parameters with respect to the planned well. The computational framework of wellbore system 100 may also account for a sensitivity of a wellbore. The computational framework of wellbore system 100 improves enables a comparison of candidate wellbore locations.

In embodiments, the computational framework considers the uncertainty parameters, including uncertainty from both the wellbore orientation and the geological layer orientation, and the resulting uncertainty on the reservoir parameters delivered by that well. Trajectories associated with combinations of uncertainty parameters and reservoir parameters to a predetermined drilling target are determined. The potential well trajectories are ranked against each other using a sensitivity analysis prior to drilling. In examples, a thickness of a target geological layer with respect to a planned intersection of wellbores with the target geological layer is calculated, wherein the target geological layer comprises a known complex geology. Generally, a complex geology refers to characteristics of the geological layer that are known to cause challenges during directional drilling. For example, a geological layer can include one or more faults, structural domes, or other stratigraphic barriers to hydrocarbon flow from the geological layer. In some cases, the well is a non-planar, non-horizontal geological structure. The parameters of the target layer (e.g. a hydrocarbon reservoir) vary with the location and length of intersection by the well (e.g. total length of reservoir in well and the resulting potential well productivity). The present techniques land high angle wells in the correct location with the desired reservoir parameters in view of changing target layer parameters.

A sensitivity of the wellbore is calculated based on parameters derived from the calculated thickness of the target geological layer. A least sensitive wellbore is selected from one or more wellbores, each wellbore representing a potential wellbore trajectory and location. The least sensitive well has a lowest uncertainty in geological layer orientation and wellbore orientation with respect to the target geographical layer.

As illustrated, the wellbore system 100 includes a wellbore trajectory 104 formed (for example, drilled or otherwise) from a terranean surface 102 and through subterranean formation 118. Although the terranean surface 102 is illustrated as a land surface, terranean surface 102 may be a sub-sea or other underwater surface, such as a lake or an ocean floor or other surface under a body of water. Thus, the present disclosure contemplates that the wellbore trajectory 104 may be formed under a body of water from a drilling location on or proximate the body of water.

The illustrated wellbore trajectory 104 is a directional wellbore in this example of wellbore system 100. For instance, the wellbore trajectory 104 includes a substantially vertical portion 106 coupled to a curved portion 108, which in turn is coupled to a substantially horizontal portion 110. As used in the present disclosure, "substantially" in the context of a wellbore orientation, refers to wellbores that may not be exactly vertical (for example, exactly perpendicular to the terranean surface 102), exactly horizontal (for example, exactly parallel to the terranean surface 102), or exactly slant (for example, exactly at a 45 degree angle with respect to the terranean surface 102). In other words, those of ordinary skill in the drill arts would recognize that vertical wellbores often undulate offset from a true vertical direction that they might be drilled at an angle that deviates from true vertical, and horizontal wellbores often undulate offset from a true horizontal direction. Further, the substantially horizontal portion 110, in some aspects, may be a slant wellbore or other directional wellbore that is oriented between exactly vertical and exactly horizontal. The substantially horizontal portion 110, in some aspects, may be oriented to follow a slant of the formation. As illustrated in this example, the three portions of the wellbore trajectory 104—the vertical portion 106, the curved portion 108, and the horizontal portion 110—form a continuous wellbore trajectory 104 that extends into the Earth. Thus, in this example implementation, at least a portion of the wellbore trajectory 104, such as the curved portion 108 and the horizontal portion 110, may be considered a high inclination, complex wellbore, in other words, a non-vertical wellbore.

As illustrated, the wellbore trajectory 104 extends through one or more subterranean layers. A geological layer 118 is subterranean formation that includes the substantially vertical portion of the wellbore 106. The curved portion 108 and substantially horizontal portion 110 and ends in the geological layer 120. The geological layer 120, in this example, includes a target location selected as the landing for the substantially horizontal portion 110, for example, in order to initiate completion operations such as hydraulic fracturing operations and ultimately recover hydrocarbon fluids from the nearby geological layer 122. In some examples, the geological layer 122 is a slanted layer, and the substantially horizontal portion 110 follows the slant of the geological layer 122. In some examples, the geological layers 118, 120, and 122 are composed of shale or tight sandstone. Shale, in some examples, may be source rocks that provide for hydrocarbon recovery from the geological layers 118, 120, and 122. In some examples, the geological layers may be suitable for CO2 sequestration. In some examples, the geological layers may be suitable for circulation of fluids employed in geothermal energy extraction.

As shown in FIG. 1, the example implementation of the wellbore system 100 also includes a logging tool 124 that is communicably coupled to a downhole conveyance 126, such as a wirelines, optical line, or other data communication cable. The downhole conveyance 126 provides data from the logging tool 124 the control system 128, in real time (for example, during logging operations) or for later usage in determining an optimal well location for high inclination complex well trajectories. In examples, the downhole conveyance 126, logging tool 124, and control system 128 enables Logging While Drilling (LWD) and may include a steerable assembly associated with the drillbit to enable real time updates to be enacted while drilling according to an actual drill trajectory. In some aspects, the control system 128 comprises a microprocessor based control system that includes, for example, one or more hardware processors, one or more memory storage devices (for example, tangible, non-transitory computer-readable memory modules), one or more network interfaces, and one or more input/output devices, including, for example, a graphical user interface (GUI) to present one or more determinations or data from the computer framework for determining an optimal well location for high inclination complex well trajectories. In embodiments, the logging tool 124, downhole conveyance 126, and control system 128 are operable to perform drilling operations based on an optimized well location for high-inclination, complex well trajectories as described herein.

Generally, wells drilled into the deep subsurface for hydrocarbon production or other purposes may have complex (i.e. non-vertical) trajectories for several reasons. For example, the surface location may be constrained to be distant from the subsurface target location. There may be a requirement for the well to penetrate the target with a small intersection angle to allow a long section of the target geological layer to be exposed in the wellbore, usually requiring the well to be at high inclination. Complex, non-vertical wells are described as two-dimensional (2D) if their trajectory can be contained within a single non-curved vertical plane. Wells are termed three-dimensional (3D) if their trajectory changes in inclination and azimuth along the wellbore, resulting in a wellbore that is curved in plan view. In the example of FIG. 1, the illustrated wellbore trajectory represents a 3D wellbore.

In some cases, the geological layers of a drilling target location are not horizontal, that is, they may be inclined by a certain amount, facing a certain direction. In embodiments, the combination of inclined geological layers with high inclination and complex well paths to hit a drilling target guides a calculation of the intersection angle of the well with the geological layers. Traditional techniques calculate the intersection angle based on a 3D geological model that represents the spatial variation in geological layer orientation. These geological models generally do not take into account uncertainty in the orientation of geological layers, therefore traditional techniques fail to determine how susceptible a given well plan is to failing to achieve objectives in the event of the geological layers at the target location having a different inclination or azimuth from expectations. Put another way, traditional techniques are based on models with fixed geological layers and do not consider the impact of uncertainty in the orientation of fixed geological features on the resulting well plan. In turn, potential target trajectories for a given well are not ranked in relation to the impact of uncertainty in the orientation of fixed geological features on the resulting well plan using traditional techniques.

The present techniques enable comparisons of potential well trajectories of one or more wells in view of uncertainties in the geological layers, thereby reducing the possibility of drilling unnecessarily risky wells that may fail and require sidetracks or redrills that cost unforeseen money and time. In particular, the present techniques automatically calculate variations in an intersection angle according to uncertainties in each of the well path and geological orientations. This highlights which uncertainty parameters (either in the geological model or well plan) contribute the highest uncertainty at a given location. This information guides closer scrutiny of the well orientation and reservoir orientation parameters that generate the highest uncertainty for a given well trajectory. Generally, well path uncertainty can arise from tool measurement error in the drilled section of the well, plus additional uncertainty in terms of what is achievable in terms of drilled well orientation in the remaining section to be drilled ahead of the drillbit. The present techniques are applicable to well trajectories at multiple alternative locations to hit a drilling target. Additionally, the present techniques enable ranking of multiple alternative well trajectories, and the selection of a best choice of well trajectory in geometrical terms as measured by the least chance of requiring a sidetrack or re-drilling of a well.

For ease of description, the present techniques are described in terms of well planning. However, the present techniques can be implemented in real-time to provide geosteering, which includes determining changes in a wellbore trajectory (at least, that portion that remains to be drilled) as the well progresses. In embodiments, geosteering is practiced in response to variations in the geology from what was anticipated in the plan as compared to real-world drilling of the well. Variations can be, for example, variance in depth, layer thickness, orientation, and the like. The present techniques can be used to implement dynamic well trajectory management, wherein alternative revised targets are compared.

Figure 2:
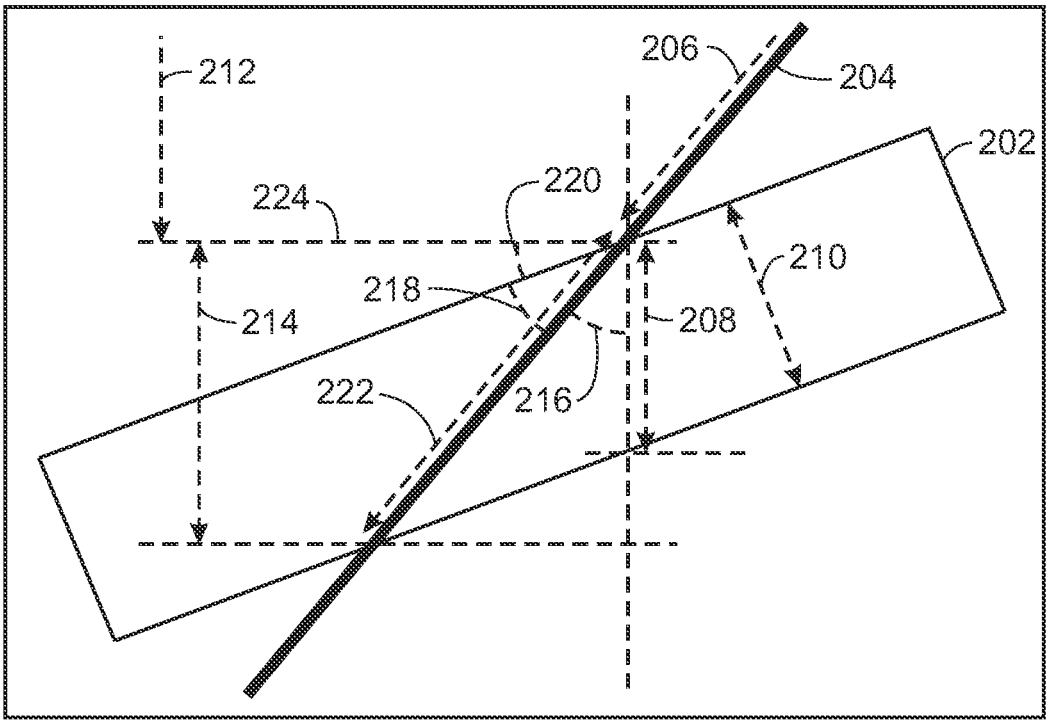
FIG. 2 is an illustration of parameters used to calculate the thickness of a target geological layer.

FIG. 2 is an illustration of reservoir parameters 200 used to calculate the thickness of a target geological layer as will be seen in a drilled well 204. The drilled well may be, for example, a well of the well system 100 illustrated in FIG. 1. In the example of FIG. 2, a geological layer 202 is illustrated. The geological layer 202 can be any geological layer 118, 120, or 122 of FIG. 1. The wellbore 204 is represented by a line across the geological layer 202. Various depth, thickness and orientation parameters are illustrated. In the example of FIG. 2, the parameters associated with the geological layer 202 are a measured depth from datum 206 along the length of the wellbore, a total vertical thickness (TVT) 208, a true stratigraphic thickness (TST) 210, a total vertical depth (TVD) 212, a vertical thickness (VT) 214 of layer 202 in the well. Angles include well inclination 216, intersection angle 218, and geological layer dip 220. Angles also include well azimuth (not shown), and geological layer dip azimuth (not shown). As illustrated, the ΔMD 222 is the length of the geological layer that is exposed in the wellbore.

The present techniques calculate a thickness of the target geological layer as will be seen in the planned well according to a planned intersection between a wellbore and the target geological layer (e.g., ΔMD 222). The present techniques calculate the intersection angle 218 using the direction cosines of two lines: the wellbore 204 and the pole to bedding 224 (a single line at ninety degrees to the geological layer) of the target geological layer that describes the orientation of the geological structure (e.g., geological layer 202) at any point. The intersection angle 218 between the wellbore 204 and geological layer 202 is the geometrical complementary angle to the direction cosines of the two lines. The intersection angle 218 combined with the minimum thickness of the geological target (TST 210, as measured at ninety degrees to the geological layer) and the orientation of the wellbore yields the other parameters, such as vertical thickness 208 of the geological target layer in the wellbore and the ΔAMD 222 of the geological target along the length of the wellbore. Thus, in embodiments the planned intersection angle and a minimum thickness of the target geological layer are used to calculate the reservoir parameters, including but not limited to MD 206, TVT 208, TST 210, TVD 212, and VT 214 of a respective well.

Figure 3:
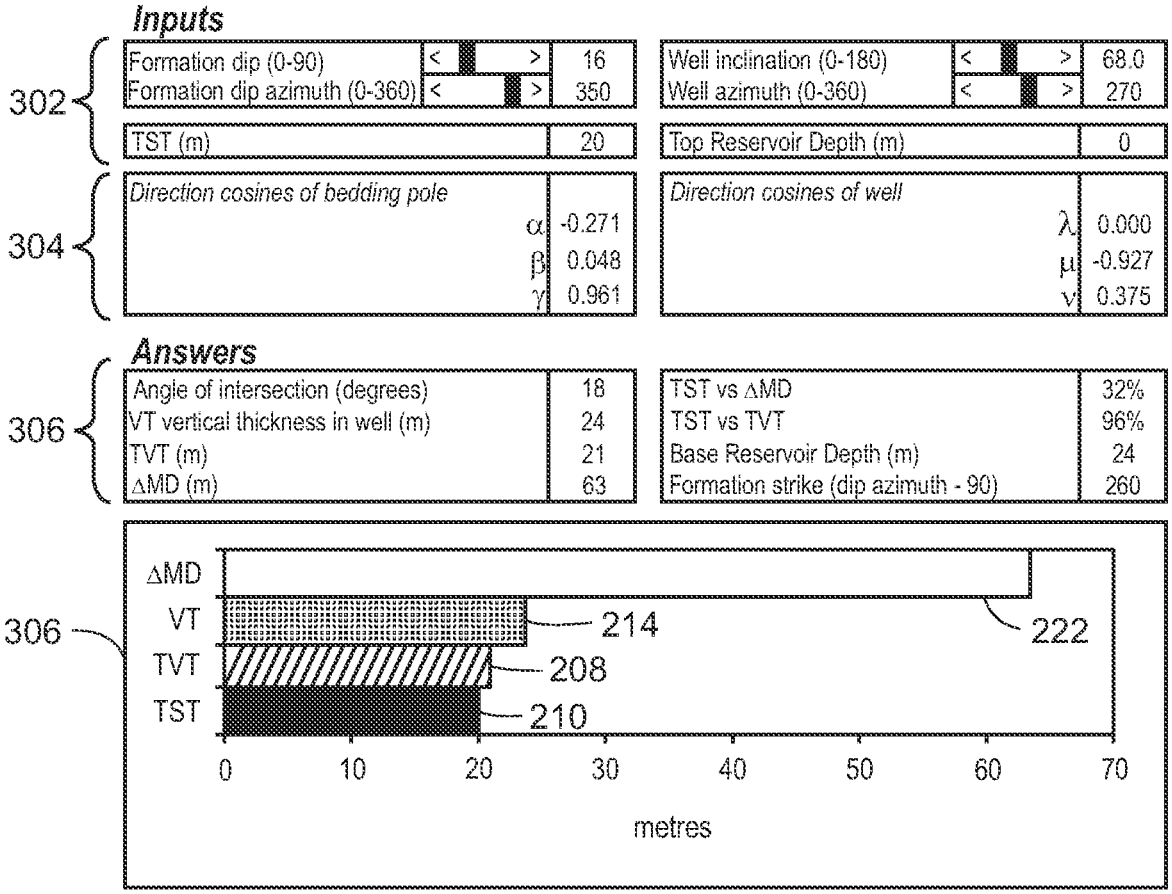
FIG. 3 is an illustration of a graphical user interface (GUI) for a geological structure intersection calculator.

FIG. 3 is an illustration of a graphical user interface (GUI) 300 for a geological structure intersection calculator. In the example of FIG. 3, angles are measured in degrees and depth units in meters. However, the specific units can be easily changed, or mixed, as the user requires (to depths in feet for instance.

In the example of FIG. 3, a single scenario case of intersection angle calculation between a wellbore and a geological layer is illustrated. The set up enables a user to manually examine specific parameters that describe a particular geological layer orientation and wellbore orientation, illustrated as inputs at reference number 302. In the example of FIG. 3, the geological layer orientation and wellbore orientation are described in terms of geological layer dip, geological layer dip azimuth, well inclination, and well azimuth. In the GUI 300, the values for the inputs are changed by manipulating the sliders that control the associated numerical values. The values for the inputs are also entered directly, without the use of sliders. In embodiments, geometrical uncertainty in the reservoir describes uncertainty in the structural orientation and thickness of a reservoir at the length scale relevant to the well objectives. FIG. 3 is an example of calculating specific parameters (outputs 306) from a given geological orientation and wellbore combination as illustrated by inputs 302 and 304. In the example of FIG. 3, uncertainty is investigated manually by manipulating with the sliders (i.e. adjusting the values slightly to observe the corresponding outputs).

As illustrated at reference number 304, the direction cosines of bedding pole and the direction cosines of the well are calculated using the inputs. The resulting output parameters are provided at reference numbers 306 and 308. In particular, at reference number 306, the intersection angle 218, TVT 208, VT 214, and ΔMD 222 are provided. Additionally, TST vs. ΔMD, TST vs. TVT, base reservoir depth, and formation strike are also calculated and output. At reference number 308, TVT 208, TST 210, VT 214, and ΔMD 222 are illustrated in graph form. A geometrical uncertainty (well inclination, well azimuth, geological layer dip or geological layer dip direction) that is most impactful at a given target trajectory with a planned intersection angle is determined by varying the input parameters.

Figure 4:
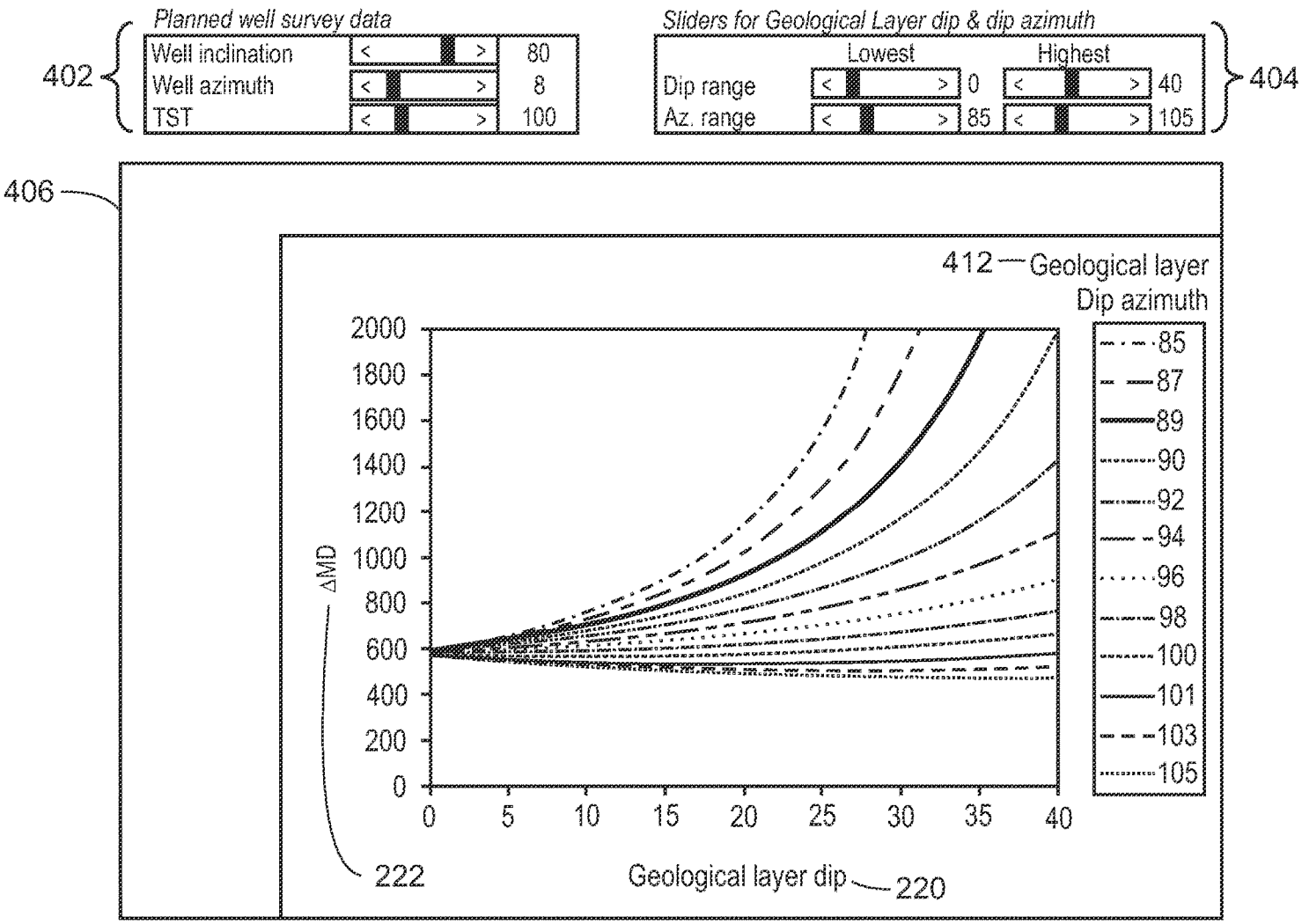
FIG. 4 is an illustration of GUI that outputs a result for ranges of the parameters described in FIG. 3.

FIG. 4 is an illustration of GUI 400 that outputs a result for ranges of the input parameters described in FIG. 3, namely formation layer dip and geological layer dip azimuth, and wellbore inclination and azimuth. In particular, FIG. 4 is an illustration of the effect of geological layer dip and azimuth variation on the change in measured depth for a given TST. In the example of FIG. 4, planned well survey data is illustrated at reference number 402, and geological layer dip and geological layer dip azimuth are illustrated at reference number 404. In the GUI 400, the values for the planned well survey data at reference number 402 and geological layer dip azimuth at reference number 404 are changed by manipulating the sliders that control the associated numerical values. At reference number 406, a graph is illustrated that represents the calculated geological layer dip azimuth 412, as defined by the geological layer dip 220, and ΔMD 222 for a well. In the example of FIG. 4, the length of reservoir quickly increases (as shown by an increase in ΔMD 222) with increasing geological layer dip 220 and decreasing geological layer dip azimuth 412. Thus, FIG. 4 illustrates a sensitivity of the length of a well to uncertainty in the geological layer orientation, with the geological layer orientation split into components of dip and dip azimuth. For ease of description, geological layer dip azimuth 412 is illustrated in the example of FIG. 4. In embodiments, wellbore inclination and azimuth are provided instead of the geological layer dip and dip azimuth illustrated in FIG. 4. The output using wellbore inclination and azimuth can be, for example, ΔMD or some other output (e.g. VT in well).

Figure 5:
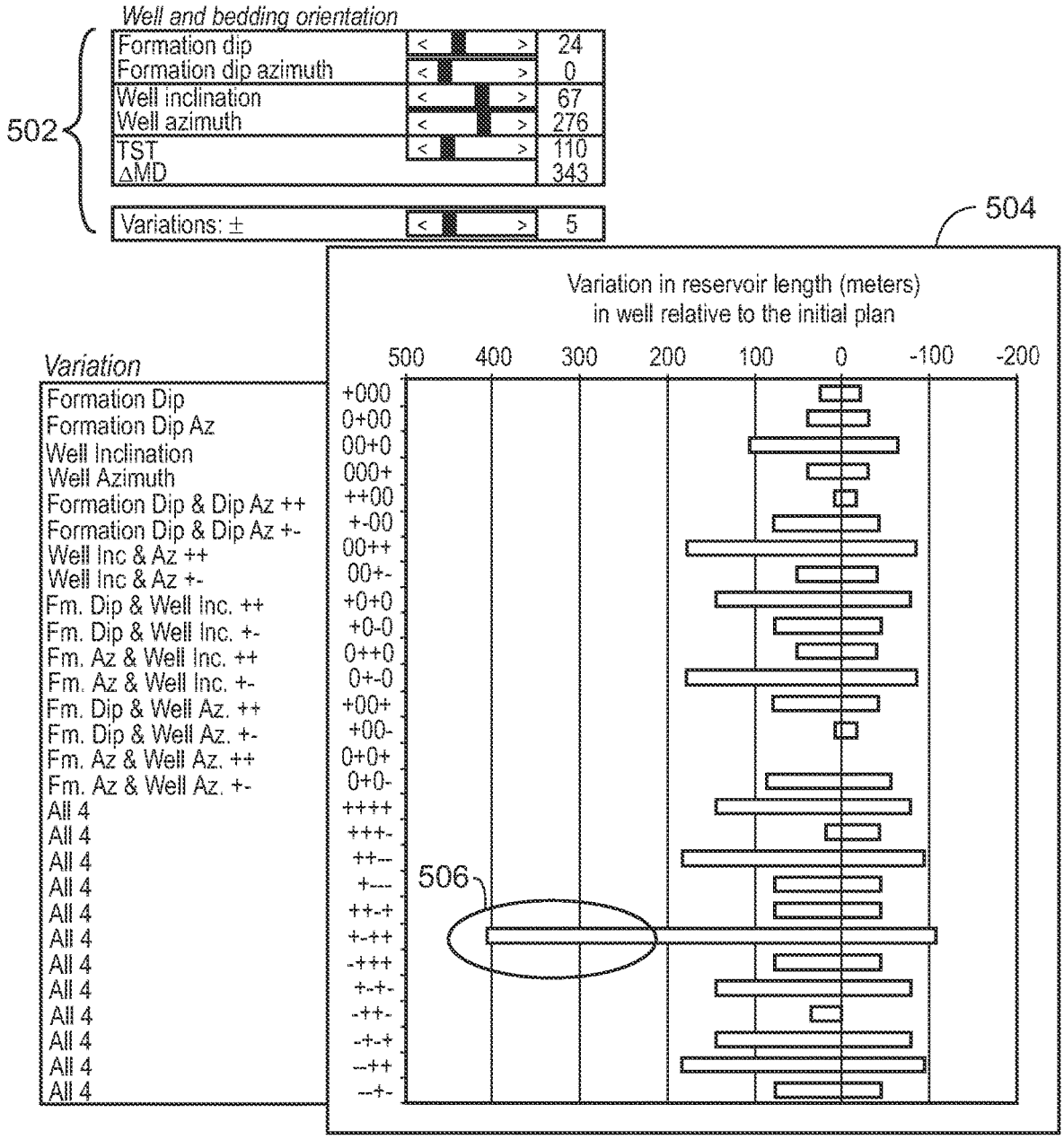
FIG. 5 illustrates sensitivity of the length of a well to uncertainty in the geological layer orientation and well orientation.

FIG. 5 illustrates sensitivity of the length of a well to uncertainty in the geological layer orientation (geological layer dip and geological layer dip azimuth), well inclination, and well azimuth. Varying these parameters (well orientation and formation orientation) enables capture of the impact on key parameters such as reservoir length in the wellbore as illustrated in FIG. 5, where the impact of uncertainties in individual parameters, specified by the variations parameter, are compared in a tornado chart for a well trajectory. The chart 500 is governed by well and bedding orientation values illustrated at reference number 502. In the chart 500, various combinations of input parameters are provided, and the combinations of input parameters that yield the most uncertain outcome in terms of reservoir length in the drilled well are determined. In the example of FIG. 500, the most uncertain outcome is illustrated at reference number 506. Based on the combination of input parameters and outcome certainties, the present techniques determine whether variations in the geology, or the wellbore, will have the biggest impact on the outcome (e.g., length of the trajectory). Actions are taken, if necessary, to compensate and reduce the uncertainty.

The particular well trajectory selected is based on combinations of variations in well and geological layer orientation uncertainties. As illustrated in FIG. 5, the present techniques can be extended to include all combinations of variation in well and geological layer orientation. This can reveal specific combinations of variation in geometrical parameters that result in anomalously large impact on the well objectives (e.g. the reservoir section being too long so that the full reservoir section is difficult to be drilled by the planned well).

To calculate the geometric uncertainties associated with a wellbore geology intersection angle at a target wellbore, the uncertainties are estimated and input to a model that varies the uncertainties one at a time, and in various combinations. If information is available to constrain the geometric uncertainty estimates, from outcomes of previous wells for example, then hard numbers can be used for the uncertainties.

In examples, well inclination uncertainties are determined through well inclination measurements. For example, well inclination is routinely measured in drilling tools incorporated in the drill bit. These drilling tools have a standard accuracy and uncertainty envelope and an additional element of wellbore uncertainty arises from the ability of the drill bit to achieve a given well plan. Similarly, well azimuth is routinely measured using drilling tools incorporated in the drill bit. The standard accuracy and uncertainty envelope of the drilling tool can be used to determine well azimuth uncertainty. There is also an additional element of wellbore uncertainty that arises from the ability of the drill bit to achieve a given well plan.

In examples, geological layer dip uncertainty is calculated from actual geological layer dip measurements compared to pre-well geological layer dip measurements. In some cases, geological layer dip uncertainty is calculated from depth conversion sensitivities in the subsurface mapping process that infills geological structure between wells on the basis of reflection seismic data. The reflection seismic data is converted to depth with assumed seismic velocities. In examples, geological layer dip direction uncertainty calculated in a similar manner as geological layer dip.

The present techniques evaluate the uncertainties in geological layer orientation and wellbore orientation to characterize one or more well locations for a target well trajectory. Generally, parameters as described with respect to FIG. 2 are used to automatically calculate variations in well-geology intersection angles according to the well path and geological orientation. The present techniques also incorporate the sensitivity of a given intersection angle to variations in the uncertainty, as shown in FIGS. 4 and 5. Generally, sensitivity analysis is the ability to explore a geometrical space that includes the uncertainties in geological layer orientation and wellbore orientation. Through sensitivity analysis, the impact of the uncertainties on a well location and other well objectives such as reservoir length in the wellbore are isolated and compared to identify a most impactful uncertainty. The sensitivity analysis is applied to multiple potential well trajectories, enabling ranking of the well trajectories in terms of their suitability to deliver well objectives such as length of reservoir within the wellbore. In some cases, a most impactful geometrical uncertainty at a given target location is described as a highest uncertainty when compared with the other geometrical uncertainties in terms of the impact on well objectives. In examples, a most impactful geometrical uncertainty is defined in terms of an absolute value of the uncertainty. For instance, a small change in formation structural dip might cause a big change in reservoir thickness in the well, whereas a bigger change in formation structural azimuth may not have such a pronounced effect.

Figure 6:
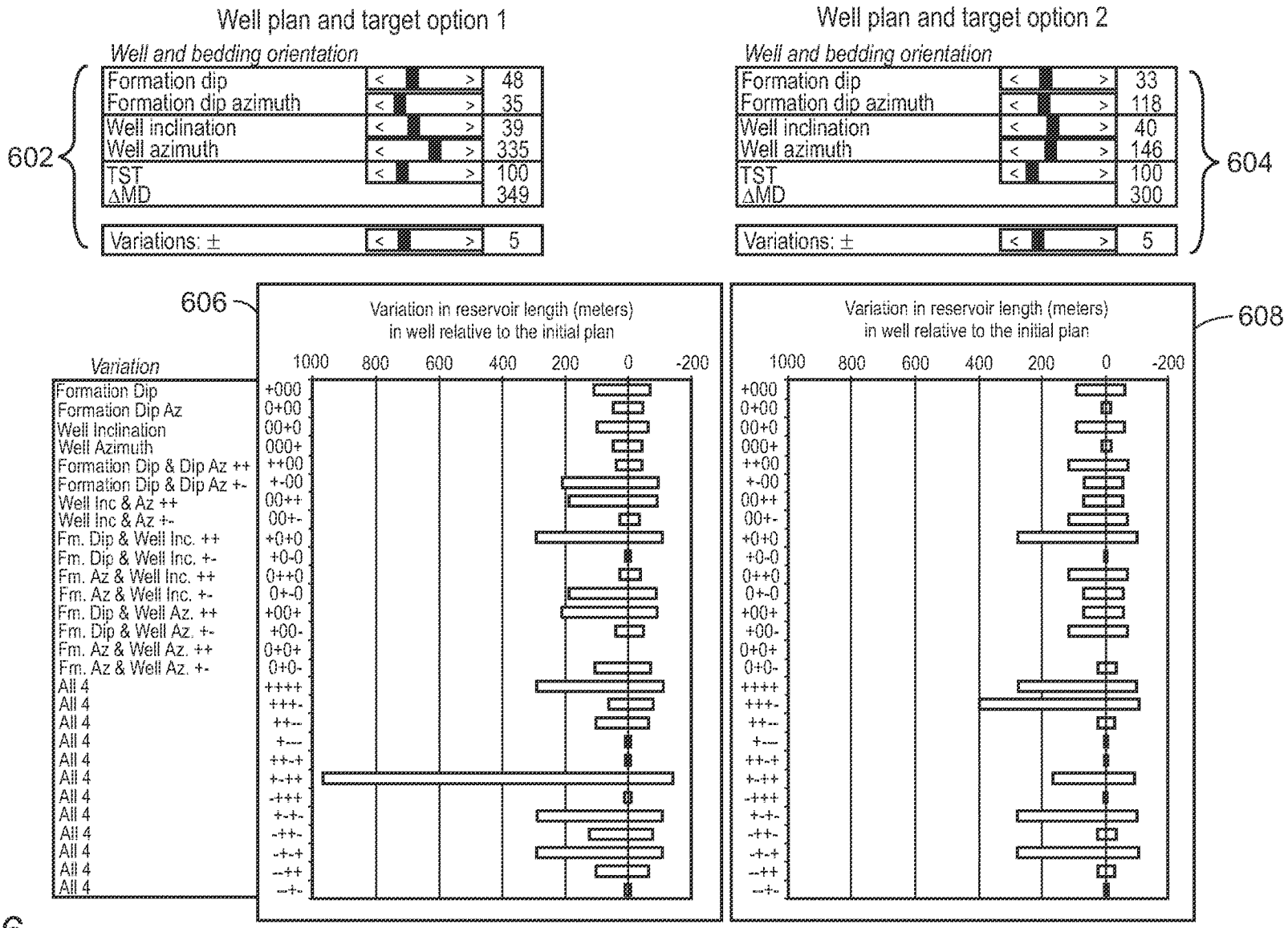
FIG. 6 is an illustration of two alternative trajectories to land a high angle well at a target location of relatively complex geology.

FIG. 6 is an illustration of two alternative trajectories to land a high angle well at two alternative target locations of relatively complex geology (i.e. where the orientation of geological layering is variable from one place to another). Generally, in the example of FIG. 6 a first option 602 has impactful reservoir and well orientation combinations that create a large amount of uncertainty. A second option 604 is robust in view of all combinations of reservoir and well orientations.

A sensitivity analysis provides that second option 604 is less sensitive to uncertainty in geological layer orientation and wellbore orientation when compared to a first option 602. This is due to the second option 604 not showing any permutations that lead to extremely long reservoir sections. The second option 604 would be the preference to minimize issues arising from exposure to uncertainty in geological layer orientation and wellbore orientation at the planned intersection angle of the second option 604. In the example of FIG. 6, the potential well trajectories illustrated at reference number 606 are calculated based on the reservoir parameters and uncertainty parameters illustrated at the first option 602. The potential well trajectories illustrated at reference number 608 are calculated based on the reservoir parameters and uncertainty parameters illustrated at the first option 604. At reference number 610, the potential well trajectories illustrated at reference number 606 includes an extremely long reservoir section when compared to the other potential well locations. The selection of the second option 604 for drilling operations lowers risks associated with the individual well. In embodiments, the workflow is repeated over an entire drilling program of many wells in the area of interest and yields considerable savings relative to the outcome by considering these uncertainties across an area of interest.

Figure 7:
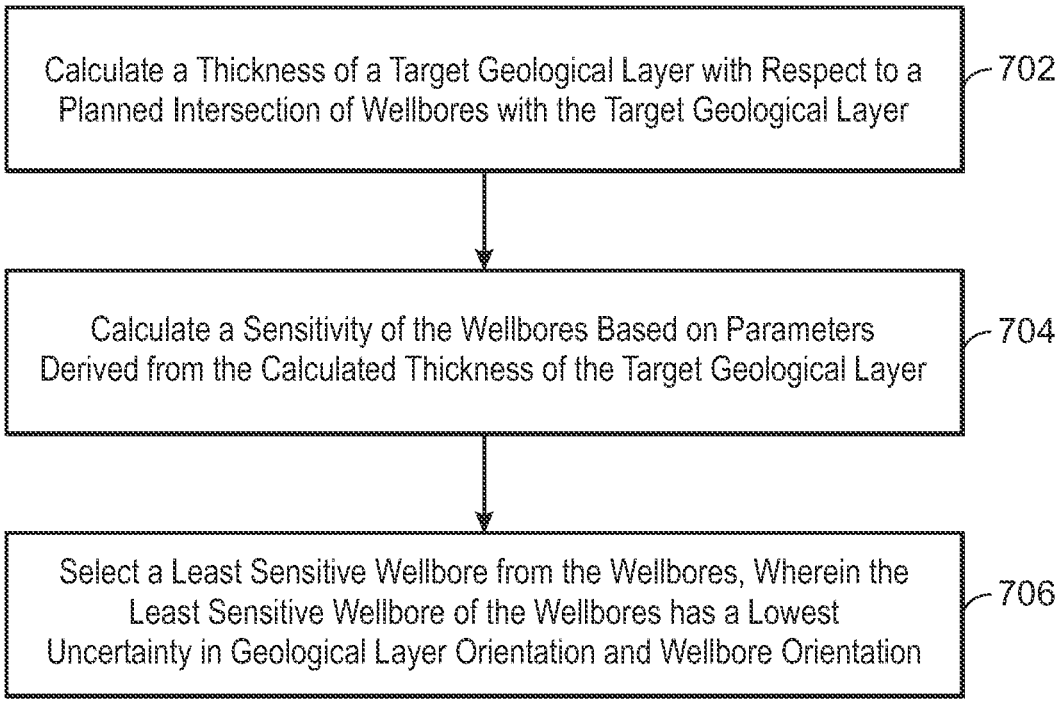
FIG. 7 is a process flow diagram of a method for an optimal well location for a high inclination, complex well.

FIG. 7 is a process flow diagram of a method for an optimal well location for a high inclination, complex well. At block 702, a thickness of a target geological layer with respect to a planned intersection angle between wellbores and the target geological layer is calculated. In embodiments, the calculation of the thickness of a target geological layer is based on an input of the basic layer thickness (TST). In embodiments, the calculated thicknesses are derivative, such that TVT, VT and ΔMD are based on the various orientation parameters. In embodiments, the target geological layer comprises a known complex geology. Generally, there are a plurality of targets and wellbores, though there may only be one target geological layer. The different targets are different places that the plurality of wellbores might land.

At block 704, a sensitivity of the wellbores is calculated based on parameters derived from the calculated thickness of the target geological layer in the planned wellbore. At block 706, a least sensitive wellbore is selected from the wellbores. In embodiments, the least sensitive wellbore of the wellbores has a lowest uncertainty in geological layer orientation and wellbore orientation. Generally, the well with the lowest uncertainty is selected for inclusion in a well plan. Ultimately, the well plan guides drilling operations, including drilling the trajectory of the selected least sensitive wellbore. In examples, additional parameters govern a final well trajectory, such as well spacing and well offset from fluid contacts. In embodiments, the present techniques guide re-planning a given well to lower uncertainty in a new well plan when compared to an initial well plan. This can result in, for example, changing the planned well azimuth.

Accordingly, in embodiments the present techniques determine optimal target trajectories for high angle, complex wells in terms of reducing exposure of the drilling operation to subsurface uncertainty, therefore saving the cost and time associated with extra drilling to achieve targets. The present techniques enable prioritizing trajectories in terms of the sensitivity of the trajectories to geometrical uncertainty, where high uncertainties make it possible the well objectives are not met. The present techniques provide users with a tool that can quickly screen individual target trajectories in terms of the orientation of geological layering at an intersection with a geological layer and the orientation of first-pass well plans that would intersect the target while honoring the basic well planning constraints of the area. The present techniques evaluate uncertainty in a quantitative way, in terms of orientation of the geological layers. Traditional techniques do not evaluate uncertainty in terms of orientation of the geological layers. Moreover, the traditional techniques do not characterize uncertainty in the orientation of geological layers at the target location. Therefore, traditional techniques will be prone to adverse outcomes in the event of the geological target being oriented differently from the deterministic prognosis (though within the uncertainty range that this disclosure is designed to capture). The present techniques explicitly incorporate geometrical uncertainty at the target location. The present techniques reduce the number of unplanned sidetracks and redrills.

Figure 8:
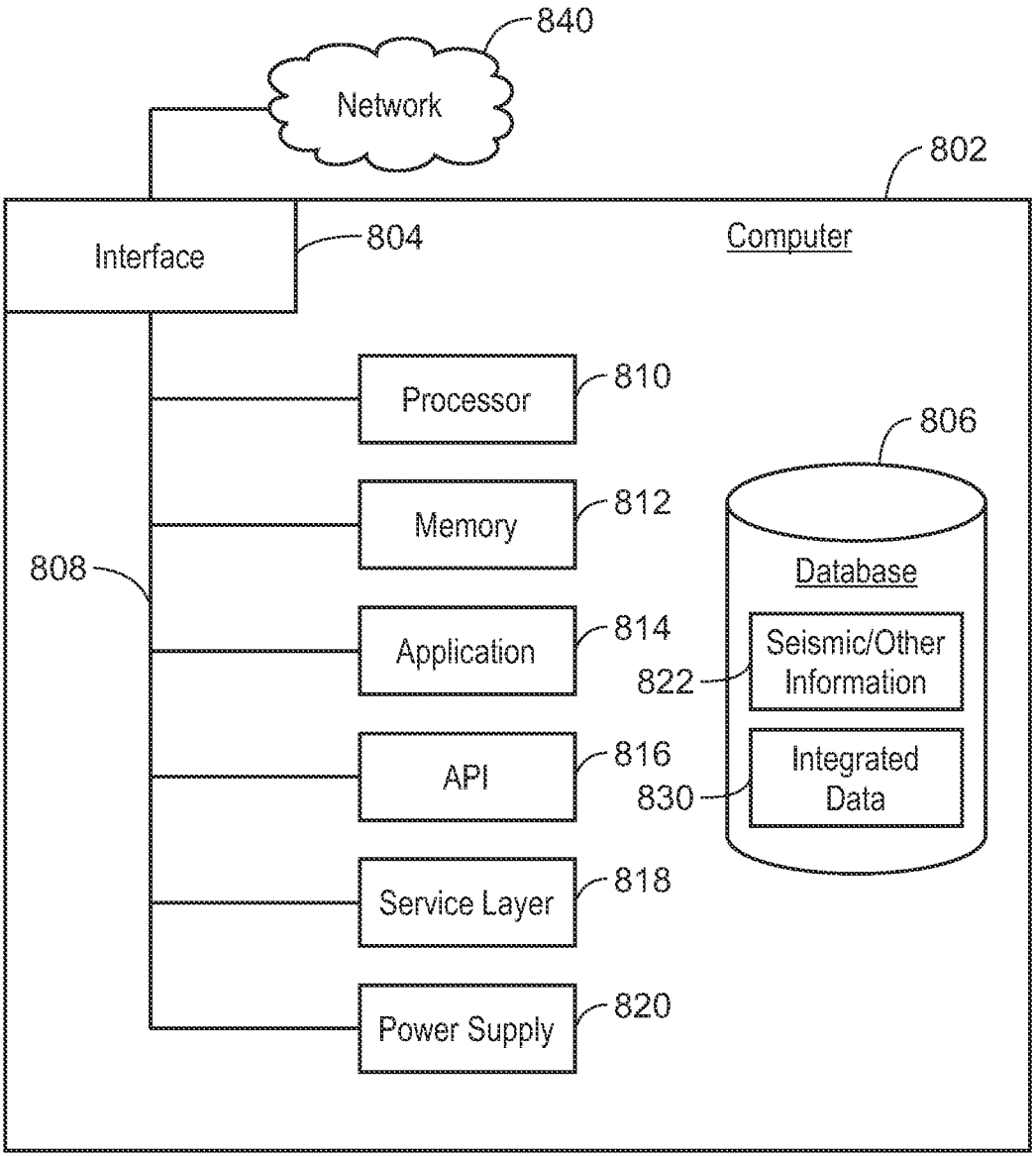
FIG. 8 is a block diagram of an example computer system.

FIG. 8 is a block diagram of an example computer system 800 used to provide computational functionalities associated with described algorithms, methods, functions, processes, flows, and procedures described in the present disclosure, according to some implementations of the present disclosure.

The illustrated computer 802 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 802 can include input devices such as keypads, keyboards, and touch screens that can accept user information. Also, the computer 802 can include output devices that can convey information associated with the operation of the computer 802. The information can include digital data, visual data, audio information, or a combination of information. The information can be presented in a graphical user interface (UI) (or GUI).

The computer 802 can serve in a role as a client, a network component, a server, a database, a persistency, or components of a computer system for performing the subject matter described in the present disclosure. The illustrated computer 802 is communicably coupled with a network 840. In some implementations, one or more components of the computer 802 can be configured to operate within different environments, including cloud-computing-based environments, local environments, global environments, and combinations of environments.

Generally, the computer 802 is an electronic computing device operable to receive, transmit, process, store, and manage data and information associated with the described subject matter. According to some implementations, the computer 802 can also include, or be communicably coupled with, an application server, an email server, a web server, a caching server, a streaming data server, or a combination of servers.

The computer 802 can receive requests over network 840 from a client application (for example, executing on another computer 802). The computer 802 can respond to the received requests by processing the received requests using software applications. Requests can also be sent to the computer 802 from internal users (for example, from a command console), external (or third) parties, automated applications, entities, individuals, systems, and computers.

Each of the components of the computer 802 can communicate using a system bus 808. In some implementations, any or all of the components of the computer 802, including hardware or software components, can interface with each other or the interface 804 (or a combination of both), over the system bus 808. Interfaces can use an application programming interface (API) 816, a service layer 818, or a combination of the API 816 and service layer 818. The API 816 can include specifications for routines, data structures, and object classes. The API 816 can be either computer-language independent or dependent. The API 816 can refer to a complete interface, a single function, or a set of APIs.

The service layer 818 can provide software services to the computer 802 and other components (whether illustrated or not) that are communicably coupled to the computer 802. The functionality of the computer 802 can be accessible for all service consumers using this service layer. Software services, such as those provided by the service layer 818, can provide reusable, defined functionalities through a defined interface. For example, the interface can be software written in JAVA, C++, or a language providing data in extensible markup language (XML) format. While illustrated as an integrated component of the computer 802, in alternative implementations, the API 816 or the service layer 818 can be stand-alone components in relation to other components of the computer 802 and other components communicably coupled to the computer 802. Moreover, any or all parts of the API 816 or the service layer 818 can be implemented as child or sub-modules of another software module, enterprise application, or hardware module without departing from the scope of the present disclosure.

The computer 802 includes an interface 804. Although illustrated as a single interface 804 in FIG. 8, two or more interfaces 804 can be used according to particular needs, desires, or particular implementations of the computer 802 and the described functionality. The interface 804 can be used by the computer 802 for communicating with other systems that are connected to the network 840 (whether illustrated or not) in a distributed environment. Generally, the interface 804 can include, or be implemented using, logic encoded in software or hardware (or a combination of software and hardware) operable to communicate with the network 840. More specifically, the interface 804 can include software supporting one or more communication protocols associated with communications. As such, the network 840 or the interface's hardware can be operable to communicate physical signals within and outside of the illustrated computer 802.

The computer 802 includes a processor 810. Although illustrated as a single processor 810 in FIG. 8, two or more processors 805 can be used according to particular needs, desires, or particular implementations of the computer 802 and the described functionality. Generally, the processor 810 can execute instructions and can manipulate data to perform the operations of the computer 802, including operations using algorithms, methods, functions, processes, flows, and procedures as described in the present disclosure.

The computer 802 also includes a database 806 that can hold data, including seismic data 822 (for example, geological layer data described earlier at least with reference to FIG. 1), for the computer 802 and other components connected to the network 840 (whether illustrated or not). For example, database 806 can be an in-memory, conventional, or a database storing data consistent with the present disclosure. In some implementations, database 806 can be a combination of two or more different database types (for example, hybrid in-memory and conventional databases) according to particular needs, desires, or particular implementations of the computer 802 and the described functionality. Although illustrated as a single database 806 in FIG. 8, two or more databases (of the same, different, or combination of types) can be used according to particular needs, desires, or particular implementations of the computer 802 and the described functionality. While database 806 is illustrated as an internal component of the computer 802, in alternative implementations, database 806 can be external to the computer 802.

The computer 802 also includes a memory 812 that can hold data for the computer 802 or a combination of components connected to the network 840 (whether illustrated or not). Memory 812 can store any data consistent with the present disclosure. In some implementations, memory 812 can be a combination of two or more different types of memory (for example, a combination of semiconductor and magnetic storage) according to particular needs, desires, or particular implementations of the computer 802 and the described functionality. Although illustrated as a single memory 812 in FIG. 8, two or more memories 812 (of the same, different, or combination of types) can be used according to particular needs, desires, or particular implementations of the computer 802 and the described functionality. While memory 812 is illustrated as an internal component of the computer 802, in alternative implementations, memory 812 can be external to the computer 802.

The application 808 can be an algorithmic software engine providing functionality according to particular needs, desires, or particular implementations of the computer 802 and the described functionality. For example, application 808 can serve as one or more components, modules, or applications. Further, although illustrated as a single application 808, the application 808 can be implemented as multiple applications 808 on the computer 802. In addition, although illustrated as internal to the computer 802, in alternative implementations, the application 808 can be external to the computer 802.

The computer 802 can also include a power supply 820. The power supply 820 can include a rechargeable or non-rechargeable battery that can be configured to be either user- or non-user-replaceable. In some implementations, the power supply 820 can include power-conversion and management circuits, including recharging, standby, and power management functionalities. In some implementations, the power-supply 820 can include a power plug to allow the computer 802 to be plugged into a wall socket or a power source to, for example, power the computer 802 or recharge a rechargeable battery.

There can be any number of computers 802 associated with, or external to, a computer system containing computer 802, with each computer 802 communicating over network 840. Further, the terms "client," "user," and other appropriate terminology can be used interchangeably, as appropriate, without departing from the scope of the present disclosure. Moreover, the present disclosure contemplates that many users can use one computer 802 and one user can use multiple computers 802.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example, LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks and optical memory devices and technologies including, for example, digital video disc (DVD), CD ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship. Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

Particular embodiments of the subject matter have been described. Other embodiments are within the scope of the following claims. For example, the actions recited in the claims can be performed in a different order and still achieve desirable results. As one example, some processes depicted in the accompanying figures do not necessarily require the particular order shown, or sequential order, to achieve desirable results.

What is claimed is:

1. A computer-implemented method for well location optimization for high inclination complex well trajectories, the method comprising:

receiving, from one or more downhole logging tools during drilling of a well, measurements indicative of geological layer orientation comprising geological layer dip and geological layer dip azimuth, and wellbore orientation comprising inclination and azimuth;

calculating, with one or more hardware processors, a thickness of a target geological layer with respect to a planned intersection angle between wellbores and the target geological layer, wherein the target geological layer comprises a known complex geology and wherein the planned intersection angle is computed as a geometrically complementary angle to a direction cosine associated with a respective wellbore and a pole to bedding of the target geological layer;

calculating, with the one or more hardware processors, a sensitivity of the wellbores based on reservoir parameters derived from the calculated thickness of the target geological layer at the planned intersection angle including at least apparent measured depth (AMD), total vertical thickness (TVT), vertical thickness (VT), and true stratigraphic thickness (TST);

selecting, with the one or more hardware processors, a least sensitive wellbore from the wellbores, wherein the least sensitive wellbore of the wellbores has a lowest uncertainty in geological layer orientation and wellbore orientation; and responsive to the selecting, controlling a steerable drilling assembly to adjust a trajectory of the well in real time to follow the selected least sensitive wellbore.

2. The computer-implemented method of claim 1, wherein the planned intersection angle is calculated as a geometrically complementary angle to a direction cosine associated with a respective wellbore and pole to bedding of the target geological layer.

3. The computer-implemented method of claim 1, comprising varying the planned intersection angle based on a wellbore orientation uncertainty and geological orientation uncertainty to compare sensitives of potential well trajectories.

4. The computer-implemented method of claim 1, further comprising:

estimating, with the one or more hardware processors, geological layer orientation uncertainty and wellbore orientation uncertainty with respect to the planned intersection angle;

varying, with the one or more hardware processors, the geological layer orientation uncertainty and wellbore orientation uncertainty based on at least one constraint; and selecting, with the one or more hardware processors, a least impactful combination of geological layer orientation uncertainty and wellbore orientation uncertainty as the lowest uncertainty in geological layer orientation and wellbore orientation.

5. The computer-implemented method of claim 1, wherein the planned intersection angle and a minimum thickness of the target geological layer are used to calculate the reservoir parameters.

6. The computer-implemented method of claim 1, wherein in response to uncertain reservoir parameters an alternative planned intersection angle between wellbores and the target geological layer is selected to calculate the thickness of the target geological layer.

7. The computer-implemented method of claim 1, wherein the wellbores represent high inclination, complex well trajectories at a constrained surface location.

8. A system, comprising:

one or more memory modules;

one or more hardware processors communicably coupled to the one or more memory modules, the one or more hardware processors configured to execute instructions stored on the one or more memory models to perform operations comprising:

receiving, from one or more downhole logging tools during drilling of a well, measurements indicative of geological layer orientation comprising geological layer dip and geological layer dip azimuth, and wellbore orientation comprising inclination and azimuth;

calculating a thickness of a target geological layer with respect to a planned intersection angle between wellbores and the target geological layer, wherein the target geological layer comprises a known complex geology and wherein the planned intersection angle is computed as a geometrically complementary angle to a direction cosine associated with a respective wellbore and a pole to bedding of the target geological layer;

calculating a sensitivity of the wellbores based on reservoir parameters derived from the calculated thickness of the target geological layer at the planned intersection angle including at least apparent measured depth (AMD), total vertical thickness (TVT), vertical thickness (VT), and true stratigraphic thickness (TST);

selecting a least sensitive wellbore from the wellbores, wherein the least sensitive wellbore of the wellbores has a lowest uncertainty in geological layer orientation and wellbore orientation; and responsive to the selecting, controlling a steerable drilling assembly to adjust a trajectory of the well in real time to follow the selected least sensitive wellbore.

9. The system of claim 8, wherein the planned intersection angle is calculated as a geometrically complementary angle to a direction cosine associated with a respective wellbore and pole to bedding of the target geological layer.

10. The system of claim 8, comprising varying the planned intersection angle based on a wellbore orientation uncertainty and geological orientation uncertainty to compare sensitives of potential well trajectories.

11. The system of claim 8, further comprising:

estimating, with the one or more hardware processors, geological layer orientation uncertainty and wellbore orientation uncertainty with respect to the planned intersection angle;

varying, with the one or more hardware processors, the geological layer orientation uncertainty and wellbore orientation uncertainty based on at least one constraint; and selecting, with the one or more hardware processors, a least impactful combination of geological layer orientation uncertainty and wellbore orientation uncertainty as the lowest uncertainty in geological layer orientation and wellbore orientation.

12. The system of claim 8, wherein the planned intersection angle and a minimum thickness of the target geological layer are used to calculate the reservoir parameters.

13. The system of claim 8, wherein in response to uncertain reservoir parameters an alternative planned intersection angle between wellbores and the target geological layer is selected to calculate the thickness of the target geological layer.

14. The system of claim 8, wherein the wellbores represent high inclination, complex well trajectories at a constrained surface location.

15. An apparatus comprising a non-transitory, computer readable, storage medium that stores instructions that, when executed by at least one processor, cause the at least one processor to perform operations comprising:

receiving, from one or more downhole logging tools during drilling of a well, measurements indicative of geological layer orientation comprising geological layer dip and geological layer dip azimuth, and wellbore orientation comprising inclination and azimuth;

calculating a thickness of a target geological layer with respect to a planned intersection angle between wellbores and the target geological layer, wherein the target geological layer comprises a known complex geology and wherein the planned intersection angle is computed as a geometrically complementary angle to a direction cosine associated with a respective wellbore and a pole to bedding of the target geological layer;

calculating a sensitivity of the wellbores based on reservoir parameters derived from the calculated thickness of the target geological layer at the planned intersection angle including at least apparent measured depth (AMD), total vertical thickness (TVT), vertical thickness (VT), and true stratigraphic thickness (TST);

selecting a least sensitive wellbore from the wellbores, wherein the least sensitive wellbore of the wellbores has a lowest uncertainty in geological layer orientation and wellbore orientation; and responsive to the selecting, controlling a steerable drilling assembly to adjust a trajectory of the well in real time to follow the selected least sensitive wellbore.

16. The apparatus of claim 15, wherein the planned intersection angle is calculated as a geometrically complementary angle to a direction cosine associated with a respective wellbore and pole to bedding of the target geological layer.

17. The apparatus of claim 15, comprising varying the planned intersection angle based on a wellbore orientation uncertainty and geological orientation uncertainty to compare sensitives of potential well trajectories.

18. The apparatus of claim 15, further comprising:

estimating geological layer orientation uncertainty and wellbore orientation uncertainty with respect to the planned intersection angle;

varying the geological layer orientation uncertainty and wellbore orientation uncertainty based on at least one constraint; and selecting a least impactful combination of geological layer orientation uncertainty and wellbore orientation uncertainty as the lowest uncertainty in geological layer orientation and wellbore orientation.

19. The apparatus of claim 15, wherein the planned intersection angle and a minimum thickness of the target geological layer are used to calculate the reservoir parameters.

20. The apparatus of claim 15, wherein in response to uncertain reservoir parameters an alternative planned intersection angle between wellbores and the target geological layer is selected to calculate the thickness of the target geological layer.

* * * * *